United States Patent [19]

Acker

[11] Patent Number: 5,064,725

[45] Date of Patent: Nov. 12, 1991

[54] TURKEY TROPHY MOUNTING KIT

[76] Inventor: Tex H. Acker, R.D. #4, Lebanon, Pa. 17042

[21] Appl. No.: 645,810

[22] Filed: Jan. 25, 1991

[51] Int. Cl.[5] ..... B44C 5/04; B44C 5/06; G09F 19/00

[52] U.S. Cl. ..... 428/542.4; D11/137; 428/6; 428/16; 428/913.3; 434/296

[58] Field of Search ..... 428/6, 913.3, 542.4, 428/15, 16; 434/81, 295, 296; D11/132, 134, 137, 162

[56] References Cited

U.S. PATENT DOCUMENTS

| | | | |
|---|---|---|---|
| D. 69,106 | 12/1925 | Allebaugh | D11/162 |
| D. 148,147 | 12/1947 | Cwik | D11/162 |
| D. 314,357 | 2/1991 | McDuffie | D11/162 |
| 3,976,807 | 8/1976 | Sweeney et al. | 434/81 X |
| 4,464,440 | 8/1984 | Dotzman | 428/542.4 |
| 4,717,626 | 1/1988 | Badger | 428/542.4 |
| 4,753,024 | 6/1988 | Rinehart | 434/296 X |

FOREIGN PATENT DOCUMENTS

| | | | |
|---|---|---|---|
| 2065567 | 7/1981 | United Kingdom | 428/6 |

OTHER PUBLICATIONS

"The Turkey Hunter" (vol. 6, No. 7) Nov./Dec. 1989, p. 63, Gamebird Tail Mounting Kit Copy in 428-542.4.

*Primary Examiner*—Henry F. Epstein

*Attorney, Agent, or Firm*—Samuel M. Learned, Jr.

[57] ABSTRACT

A turkey trophy mounting kit adapted to be employed by a hunter to process for preserving, and then affixably mount upon the provided plaque for display, a cured and dried spread wild turkey gobbler tail fan, and the beard and feet thereof.

6 Claims, 2 Drawing Sheets

TURKEY TROPHY MOUNTING KIT

BACKGROUND OF THE INVENTION

The present invention relates to a turkey trophy mounting kit for use by a hunter to prepare and mount for display the tail fan, beard and feet of a wild turkey gobbler.

One of the fastest growing areas of hunting activity is currently that of taking wild turkeys, which is regarded by even experienced hunters as being one of the more challenging of the wild game species to hunt. Those who hunt trophy turkey are after a mature male, commonly referred to among turkey hunters as the "Boss Gobbler", being characterized by a large body size (usually in the twenty to twenty-five pound category), a large tail fan, a long beard (being that modified feather protrusion of eight to ten inches or so in length which hangs from the center breast portion of the bird), and a respectable set of spurs (those two to three inch or so claw-like protrusions which project rearwardly from the backs of the legs just above the toes of the feet). As it is the antler size of a horned animal which is indicative of the power and verility of the male of any particular species, it is the spread of the tail fan, and the beard and spur lengths of the male turkey which are indicative of his wariness, power and verility, and by which he is established and regarded as a trophy among men and turkeys alike.

When a hunter is both skilled and fortunate enough to harvest a trophy class wild gobbler, and he wishes to preserve and display the same, his choices are to either have a professional taxidermist do a full body mount of the bird, or for the hunter to himself remove and cure the beard and tail and in some manner effect a display of the same. Since it is not at all uncommon for an accomplished turkey hunter to both hunt and harvest trophy gobblers in several states during a single season, preservation of such trophies in the form of full body mounts is not only very costly but also not practical since the space taken up by even a single trophy class full body mounted wild turkey gobbler is substantial. Thus, in many ways and respects, not the least of which are the cost and space factors, a wall hung plaque mounted display of the spread wild turkey gobbler tail fan, with beard and feet, is the more acceptable alternative.

The prior art teaches a gamebird tail mounting kit which is manufactured and sold by the The Holding Company of San Angelo, Tex., being shown and described on page 63 of the November/December 1989 issue of "the Turkey Hunter" (Vol. 6, No. 7), which provides a plaque means for the mounting and display of a fanned turkey tail and beard. Although there are kits for the mounting of antler trophies and the like, such as exemplified in U.S. Pat. No. 4,464,440 to Dotzman dated Aug. 7, 1984, and U.S. Pat. No. 4,717,626 to Badger dated Jan. 5, 1988, as well as a teaching for an animal foot rack and kit therefor as set forth in U.S. Pat. No. 4,753,024 to Rinehart dated June 28, 1988, there are no other known methods or kits such as that herein taught for the preservation and mounting for display of a spread wild turkey gobbler tail fan with its beard and feet.

SUMMARY OF THE INVENTION

It is the principal object of the present invention to provide a turkey trophy mounting kit comprised of a process for preserving, and a plaque for mounting, a cured and dried wild turkey tail fan, beard, and feet.

It is also an object of the present invention to provide a turkey trophy mounting kit adapted to accommodate the mounting for display of a spread tail fan, the beard and feet of various size and type wild turkey trophies.

It is a further object of the present invention to provide a turkey trophy mounting kit which embodies a mounting plaque indicative of a wild turkey body, or in an alternate version a plaque indicative of the manner of taking the turkey.

It is another object of the present invention to provide a turkey trophy mounting kit which is economical yet an attractive means for mounting for display a spread tail fan, the beard and feet of a wild turkey.

Still another object of the present invention is to provide a turkey trophy mounting kit capable of being advantageously employed by one not possessed of any particular or specialized skills.

The foregoing objects, and other features and advantages of the present invention will be readily evident upon a study of the following specification when taken in conjunction with the accompanying drawings comprising a part thereof.

DETAILED DESCRIPTION OF THE INVENTION

Figure 1:
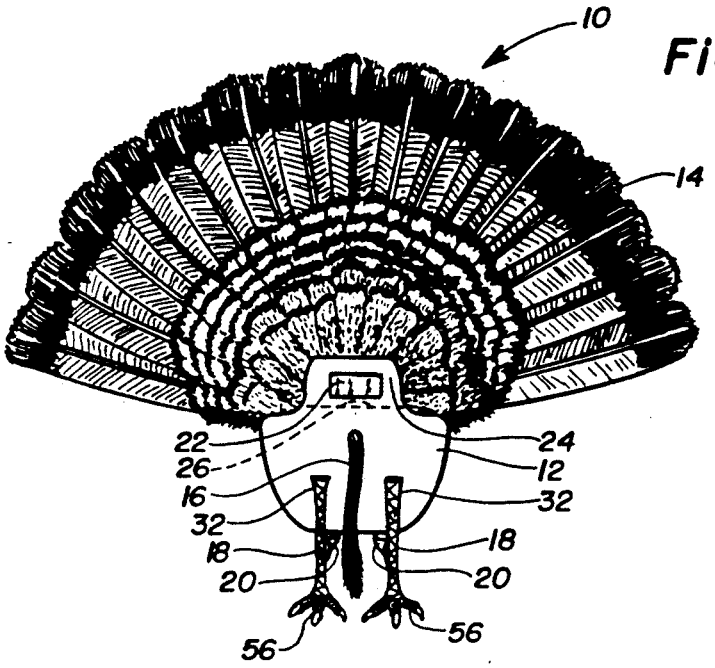
FIG. 1 is a front elevation view of an assembled turkey trophy mounting kit with an exemplary spread wild turkey tail fan, beard and feet mountably affixed thereto for display.

Referring to FIG. 1, an assembled turkey trophy mounting kit 10 of instant invention is shown, wherein the plaque component 12 thereof provides a display mount for affixment of a spread wild turkey gobbler tail fan 14, with the gobbler beard 16, and the gobbler legs 18 having spurs 20 thereon, so that the same may be suitably and attractively positioned and supported upon a trophy room wall or the like. It will be noted that the plaque component 12 has the general shape and configuration of a wild turkey body silhouette as would typically be seen from a full front view, so that the mountable affixment of a spread tail fan 14 with the beard 16 and legs 18 are positioned in the same relative anatomical relationship as would appear on the live wild turkey gobbler from which they came. Also shown in FIG. 1 is a metal engraving plate 22, affixed to the upper central portion of the plaque component 12, and upon which may be entered hunt information such as the date and place of harvest or the like.

Figure 2:
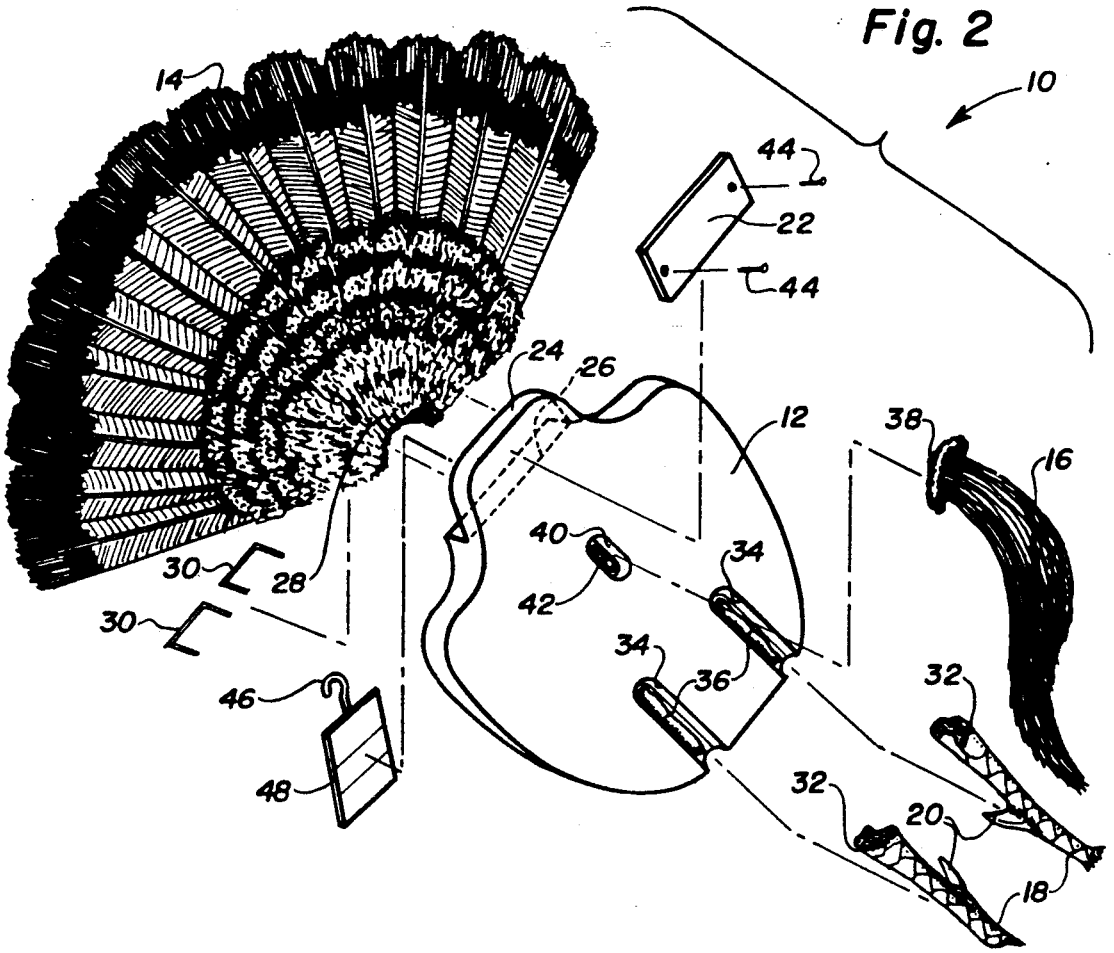
FIG. 2 is an enlarged exploded perspective elevation view of the plaque portion of the turkey trophy mounting kit of present invention, illustrating therein the manner of assembly of an exemplary spread wild turkey tail fan, beard and feet thereto for display.

Referring now to FIG. 2 to explain in greater detail the user method for assembly of the turkey trophy mounting kit 10, and considering first the user assembly of the spread tail fan 14 to the plaque component 12 thereof. As can be seen more clearly in FIG. 2, the upper portion 24 of the plaque component 12 is provided within the rearward facing side thereof with a tail fan receiving recess 26, being cut out and adapted to receive and support the base 28 of a cured and dried spread wild turkey gobbler tail fan 14. Once the user manually orients and positions the tail fan 14 suitably within the recess 26, then the user affixes the same in a spread display disposition supportably therewithin by means of one or more staples 30 which are driven by the user through the back of the tail fan base 28 and into the rearward facing surface of the upper portion 24 of the plaque component 12 so that the tail fan 14 is thereby secured in a spread display position as previously shown in FIG. 1.

The gobbler legs 18 are next affixed to the plaque component 12 by the user manually positioning and inserting the upper rear leg surfaces 32 respectively within one of the leg slot recesses 34 provided therefor, the same being in a spaced vertical relationship one with respect to the other within the front surface of said plaque component 12 to thereby simulate with reasonable corectness the relative anatomical positions therefor. Normally the diameter of the upper rear leg surfaces 32 will be slightly larger than that of the width of the leg slot recesses 34, so that a user may just simply press-fit the upper legs 32 into the slots 34 thereby to effect a compressive frictional retention of the same. However, if the relative upper leg 32 to slot 34 width is not as above described, and the upper leg 32 diameter is less than that of the slot 34 width, then the legs 18 may be retainably secured within the slots 34 by application of a ribbon of suitable adhesive 36 therewithin prior to positioning and assembling the upper legs 32 in the manner as otherwise previously described.

The last bird component to be affixed upon the plaque 12 is the gobbler beard 16 which is assembled thereto by insertion of the cured beard butt 38 into the beard retaining recess 40 provided centrally intermediate within said plaque 12. Again, a compressive fit of the beard butt 38 within the beard retaining recess 40 will normally be sufficient to effect affixment of the beard 16 to the plaque 12. Otherwise, a spot of adhesive 42 may be applied within the beard retaining recess 40 to accomplish a more suitable affixment of the beard 16 to the plaque 12.

Upon completion of the affixment of the three bird components to the plaque 12 as above described, then the plate 22 is affixed to the upper portion of the plaque component 24 by means of brads 44 so that the assembled kit 10 is as appears in FIG. 1 as previously described. Lastly, a wall hanging hook 46 is assembled to the centrally intermediate upper back portion of the plaque 12, in a specific position determined by and dependent upon the tail fan size and weight and the balance thereof with respect to the plaque 12 and the remaining assembled bird components 16 and 18. It will be noted that the particular wall hanging hook 46 which is illustrated is that type applied by means of a pressure sensitive adhesive tab 48, which is a wall hanging hook system popularly employed in such applications, and is to be herein considered as exemplary only and not limiting.

The plaque component 12 as herein illustrated and described is preferably made of a suitable hardwood such as oak or the like, it may, however, be made from other materials such as plastics or the like.

Figure 3:
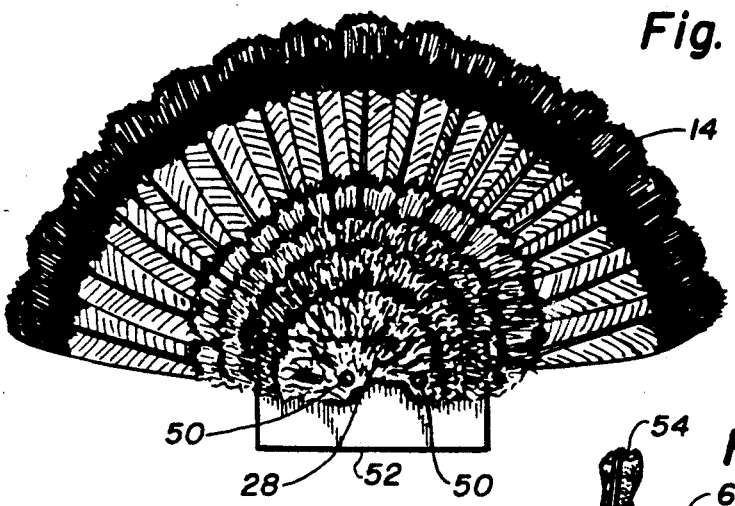
FIG. 3 is a front elevation view of the processing method and manner employed herein for curing and preserving an exemplary wild turkey tail fan in a spread disposition for mounting and display.

Turning attention now to FIG. 3, which illustrates the method and technique of curing and drying the tail fan 14 in a spread disposition as shown for mounting upon the plaque 12 as previously described. When the tail fan 14 is removed from a wild turkey gobbler it is severably detached so that the tail fan base 28 contains that fleshy portion of the tail into which the tail fan feathers attach. It is the fleshy portion of the tail fan base 28 which, when cured and dried, serves to secure the tail fan feathers and retain the same in a spread disposition for display. The technique for accomplishing curing and drying thereof is to salt the fleshy portion of the tail fan base 28 while it is still fresh and pliable, and then manually spread the tail fan 14 and fixing it in the spread disposition for curing and drying by tacking the same with tacks 50 through the tail fan base 28 to a board 52. After a week or so, depending upon the ambient temperature and humidity conditions of the environment in which the salted and tacked tail fan 14 is stored for curing and drying, it may be removed from the board 52 for mountable assembly to the plaque 12.

Figure 4:
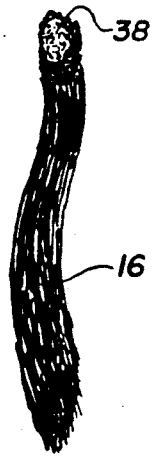
FIG. 4 is a front elevation view of an exemplary wild turkey beard and the processing method and manner employed herein for the curing and preserving thereof for mounting and display.

The view shown in FIG. 4 illustrates curing and drying of the beard butt 38, which is a fleshy portion removed from the gobbler's breast into which the strands of the beard 16 connect. Again, the method for accomplishing curing and drying is to salt the fleshy portion of the beard butt 38 while it is still fresh and pliable, and then set it aside in a well ventilated warm dry place to naturally cure and dry, which should likewise take a week or so.

Figure 5:
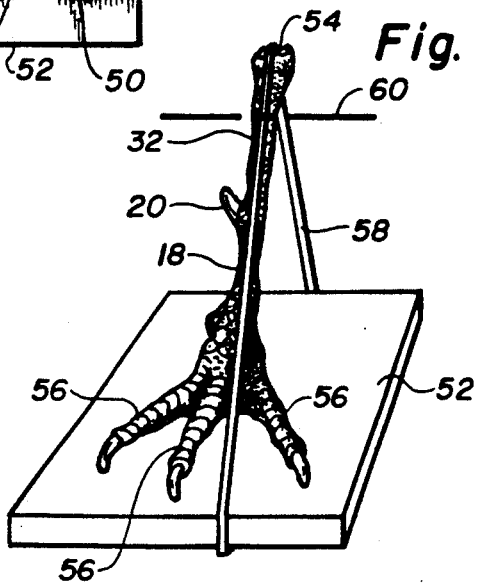
FIG. 5 is a front elevation view of an exemplary wild turkey foot and the processing method and manner employed herein for drying and preserving the same in an open upright disposition for mounting and display.

Considering now the view shown in FIG. 5, which illustrates drying of a gobbler leg 18 for mounting and display. Again, after removing the legs 18 from the wild turkey gobbler carcass respectively at the first knuckle joint 54 thereof, and while they are still fresh and pliable, the toes 56 are spread in an open and flat disposition upon the board 52 with the leg 18 projecting perpendicularly upward therefrom, and while in such a configuration a heavy rubber band 58 is stretched around the bottom of the board 52 and up over the first knuckle joint 54 to thereby hold the toes and leg in the described disposition for drying. In the case of the legs 18 no curing medium such as salt is employed, they are just simply dried. However, after drying and removal from the board 52, the knuckle joint 54 is in turn removed by cutting at line 60 and then the remainder of the leg 18 for mounting is coated with clear laquer to both bring out the color and provide added protection.

Figure 6:
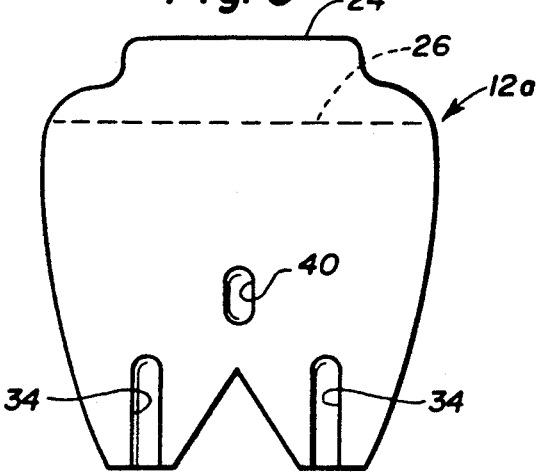
FIG. 6 is a front elevation view of an alternative version plaque configuration indicative of a wild turkey body.
Figure 7:
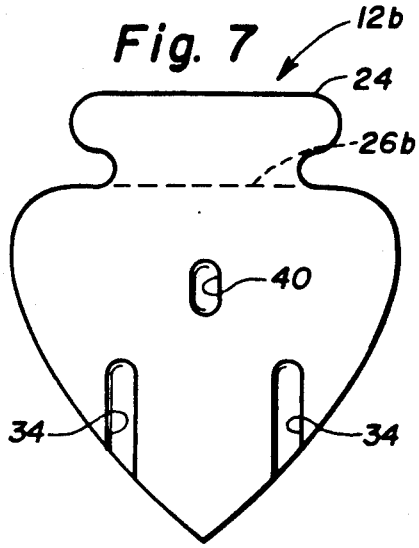
FIG. 7 is a front elevation view of an alternative version plaque configuration indicative of the manner of taking a wild turkey.

The two views shown in FIG. 6 and FIG. 7 illustrate alternate plaque component configurations **12*a* and 12*b* respectively, wherein that shown in FIG. 6 is representative of another version of a wild turkey body silhouette, and that shown in FIG. 7 is in the shape of an arrow head for use by a hunter who may have taken his gobbler by bow. It will be noted that in both alternate plaque component configurations 12*a* and 12*b* the relative positionings of the tail fan receiving recess 26, as well as those of the leg slot recesses 34 and the beard retaining recess 40 remain the same as those previously described for the basic plaque component 12** configuration.

Although the invention herein disclosed has been shown and described in what is conceived to be the most practical and preferred embodiment, it is recognized that departures may be made therefrom within the scope thereof, which is not to be limited to the specific details disclosed herein but is to be accorded the full scope of the claims so as to embrace any and all equivalent turkey trophy mounting kits adapted to be employed by an individual to process for preserving, and then fixably mount upon a provided plaque for display, a cured and dried spread wild turkey gobbler tail fan, and the beard and feet thereof.

I claim:

1. A turkey trophy mounting kit comprising in combination, a plaque component having the configuration of a typical wild turkey body silhouette as would be seen from a full front view and being provided with a tail fan receiving recess disposed in the upper rear portion thereof adapted to supportably receive for display mounting a cured and dried spread wild turkey gobbler tail fan, a spaced set of leg slot recesses disposed in the lower front portion of said plaque component to supportably receive by compressive press fit insertion respectively therein for display mounting a dried wild turkey gobbler leg each having spread toes and rearwardly projecting spurs, and a beard retaining recess disposed in the centrally intermediate front portion of said plaque component to supportably receive by compressive press fit insertion therein for display mounting a cured and dried wild turkey gobbler beard so that the mountable affixment of said tail fan and legs and beard as aforesaid respectively position the same accurately in relative anatomical relationship upon said plaque as would have typically appeared on the live wild turkey gobbler from which they came.

2. The turkey trophy mounting kit according to claim 1 wherein said plaque component has affixed to the centrally intermediate rear portion thereof a wall hanging hook.

3. The turkey trophy mounting kit according to claim 1 wherein said plaque component has affixed to the upper centrally intermediate front portion thereof a metal engraving plate.

4. The turkey trophy mounting kit according to claim 1 wherein said cured and dried spread wild turkey gobbler tail fan is securably affixed within said tail fan receiving recess by means of staples.

5. The turkey trophy mounting kit according to claim 1 wherein said dried wild turkey gobbler legs are respectively retained within said leg slot recesses by means of a ribbon of adhesive.

6. The turkey trophy mounting kit according to claim 1 wherein said cured and dried wild turkey gobbler beard is retained within said beard retaining recess by means of a spot of adhesive.

* * * * *